US010181690B1

(12) United States Patent
Brennan, Jr. et al.

(10) Patent No.: US 10,181,690 B1
(45) Date of Patent: Jan. 15, 2019

(54) MOBILE DEVICE ADAPTER

(71) Applicant: Spectralink Corporation, Boulder, CO (US)

(72) Inventors: William R. Brennan, Jr., Longmont, CO (US); Perry D. Robbins, Lafayette, CO (US); Nigel O. Robbins, Lafayette, CO (US)

(73) Assignee: SPECTRALINK CORPORATION, Boulder, CO (US)

( * ) Notice: Subject to any disclaimer, the term of this patent is extended or adjusted under 35 U.S.C. 154(b) by 0 days.

(21) Appl. No.: 15/687,250

(22) Filed: Aug. 25, 2017

(51) Int. Cl.

| | |
|---|---|
| ***H01R 25/00*** | (2006.01) |
| ***H01R 31/06*** | (2006.01) |
| ***H01R 13/22*** | (2006.01) |
| ***H01R 13/04*** | (2006.01) |

(52) U.S. Cl.
CPC ..... *H01R 31/06* (2013.01); *H01R 13/04* (2013.01); *H01R 13/22* (2013.01)

(58) Field of Classification Search
CPC ..... H01R 24/54; H01R 25/00; H01R 31/06; H01R 33/94; H01R 33/98
USPC ..... 439/638
See application file for complete search history.

(56) References Cited

U.S. PATENT DOCUMENTS

| | | | | |
|---|---|---|---|---|
| 5,314,346 | A * | 5/1994 | Owens | H01R 12/62 439/189 |
| 7,056,127 | B2 * | 6/2006 | Suzuki | H01R 13/6205 439/22 |
| 7,513,038 | B2 * | 4/2009 | Koh | H01R 13/6205 29/825 |
| 2010/0136852 | A1 * | 6/2010 | Mito | H01R 13/41 439/733.1 |

* cited by examiner

*Primary Examiner* — Phuong Dinh
(74) *Attorney, Agent, or Firm* — Polsinelli PC

(57) ABSTRACT

An adapter for a mobile device includes a housing, a connector coupled to a first side of the housing, and a plurality of adapter pins extending through the housing. Each of the adapter pins includes a first portion adapted to be electrically coupled to a corresponding port pin when the connector is inserted into a port of the mobile device. The adapter pins further include a second portion including a contact pad that is exposed on a second side of the housing opposite the first side of the housing. The adapter reduces the quantity of contact pads relative to the quantity of port pins, thereby facilitating increased contact pad sizes and improved contact pad distribution.

20 Claims, 7 Drawing Sheets

MOBILE DEVICE ADAPTER

TECHNICAL FIELD

Aspects of the present disclosure involve an adapter for use with a mobile device and, more specifically, an adapter that converts pins of a port of a mobile device to corresponding contact pads.

INTRODUCTION

Modern mobile devices are sophisticated computing devices capable of performing a wide range of functions. In addition to traditional telephonic communication, mobile devices are also capable of collecting and processing visual data for use in various applications. For example, mobile devices may be used to scan or otherwise capture barcodes and similar optical, machine-readable, representations of data to facilitate data input and/or tracking of patient information in hospitals, products in warehouses, and components in manufacturing operations. However, the increased sophistication and capabilities of mobile devices has been accompanied by an increase in the power requirements and amount of data required to be transferred from such mobile devices. Moreover, as mobile devices are integrated into everyday operations of various organizations, the importance of ensuring such devices are easily operable, remain charged, and have sufficient storage capacity for the tasks they are required to perform becomes critical.

With these thoughts in mind among others, aspects of the adapter disclosed herein were conceived.

SUMMARY

One implementation of the present disclosure is directed to an adapter for use with a mobile device, the mobile device including a port having a plurality of port pins. The adapter includes a housing, a connector adapted to be inserted into the port and coupled to a first side of the housing, and a plurality of adapter pins coupled to and extending through the housing. Each adapter pin includes a first portion including a pin end extending into the connector such that the pin end contacts a respective port pin of the plurality of port pins when the connector is inserted into the port. Each adapter pin further includes a second portion including a contact pad exposed on a second side of the housing opposite the first side. The adapter includes fewer adapters pins than port pins.

In another aspect of the present disclosure, a mobile device is provided. The mobile device includes a mobile device body including a port having a plurality of port pins. The mobile device further includes an adapter coupled to the port that includes a plurality of adapter pins. Each of the adapter pins includes a pin end and a contact pad opposite the pin end. Further, each of the adapter pins is electrically coupled with a respective port pin of a subset of the plurality of port pins.

In yet another aspect of the present disclosure, an adapter for use with a mobile device including a micro universal serial bus (USB) port is provided. The adapter includes a housing, a connector coupled to a first side of the housing and adapter to be inserted into the micro USB port, and a plurality of adapter pins extending through the housing. The plurality of adapter pins consist of a power supply adapter pin, a ground adapter pin, a high data adapter pin, and a low data adapter pin that are configured to be electrically coupled to a power supply port pin, a ground port pin, a high data port pin, and a low data port pin of the micro USB port, respectively, when the connector is inserted into the port. Each of the adapter pins further includes a contact pad that is exposed on a second side of the adapter opposite the first side.

BRIEF DESCRIPTION OF THE DRAWINGS

The foregoing and other objects, features, and advantages of the present disclosure set forth herein should be apparent from the following description of particular embodiments of those inventive concepts, as illustrated in the accompanying drawings. The drawings depict only typical embodiments of the present disclosure and, therefore, are not to be considered limiting in scope.

DETAILED DESCRIPTION

Aspects of the present disclosure involve an adapter for use with a mobile device. The adapter generally includes a set of adapter pins configured to be coupled to a port of the mobile device and to terminate in a corresponding set of contact pads. The contact pads are oriented and arranged such that, when the adapted is coupled to a mobile device, the mobile device may be more readily coupled to a docking or similar base station. In certain implementations, the size and spacing of the contact pads are improved by excluding a contact pad for one or more pins of the mobile device port.

Cradles and docking stations are commonly available for mobile devices and are generally adapted to receive the mobile device for purposes of charging the mobile device and transferring data to/from the mobile device. Conventionally, the mobile device will include a female port into which a corresponding male connector of the cradle is inserted. The port and connector include pins or similar contacts that facilitate the transfer of power or data between the devices.

The conventional design in which a male connector of the cradle is inserted into a female port of the mobile device is problematic in several ways. For example, the male connector and female port are generally positively coupled and require opposing forces to be applied to each of the cradle and the mobile device to decouple the cradle from the mobile device. Moreover, the conventional port and connector arrangement requires relatively tight manufacturing tolerances to properly align the mobile device and the cradle. Absent proper alignment, insertion of the mobile device to the cradle may be difficult and may lead to damage of one or both of the port and the connector.

To address the issues associated with conventional mobile device and cradle arrangements, the adapter of the present disclosure converts the female port of the mobile device to a set of contact pads. In certain implementations, the contact pads are enlarged and spaced relative to each other to facilitate contact with corresponding contacts of a cradle or docking station. To increase the space available for the contact pads, the adapter excludes at least one contact pad for one or more pins of the port.

Figure 1:
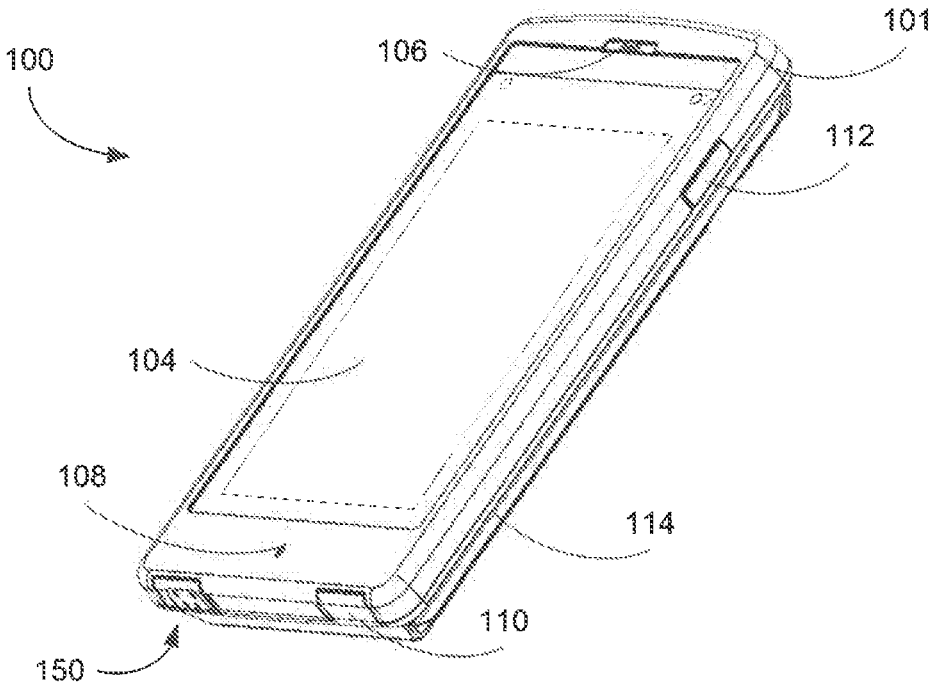
FIG. 1 is an isometric view of a mobile device including a first adapter in accordance with this disclosure.
Figure 2:
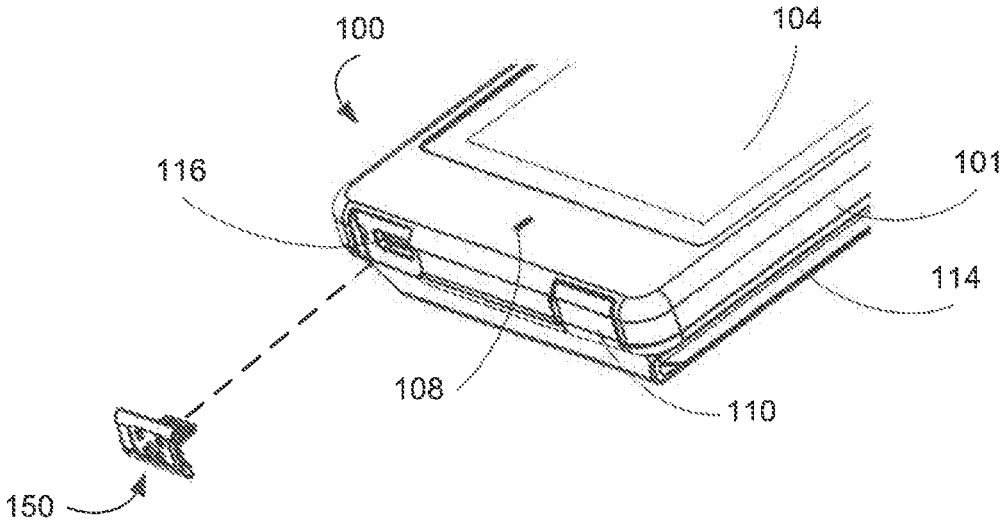
FIG. 2 is a partially exploded isometric view of the mobile device of FIG. 1.
Figure 3:
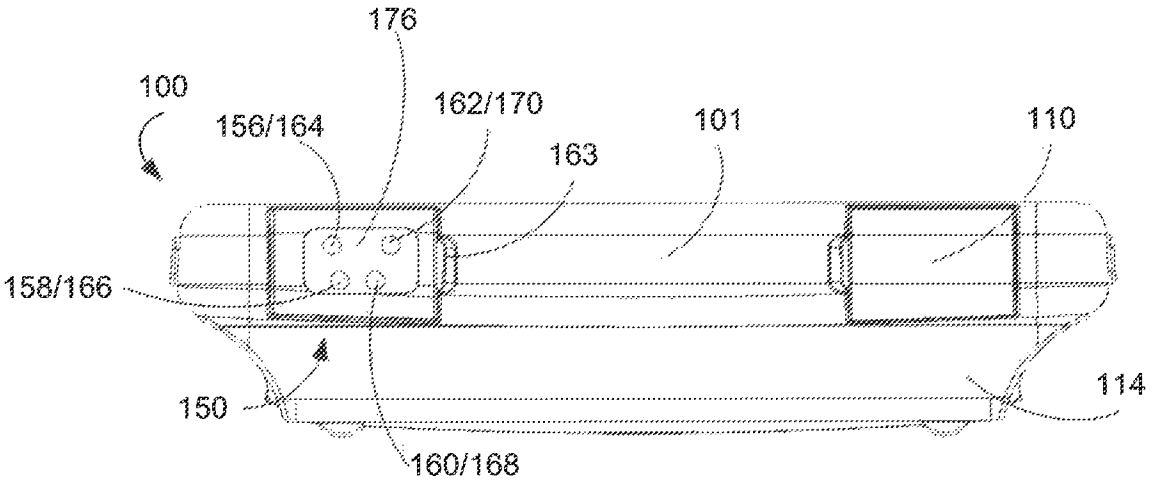
FIG. 3 is a bottom view of the mobile device of FIG. 1.

FIGS. 1-3 illustrate a mobile device 100 including an adapter 150 in accordance with this disclosure. More specifically, FIG. 1 is a first isometric view of the mobile device 100 with the adapter 150 inserted into a mobile device housing 101 of the mobile device 100. FIG. 2 is a partially exploded isometric view illustrating insertion of the adapter 150 into a port 116 of the mobile device 100. FIG. 3 is a bottom view of the mobile device 100.

The mobile device 100 illustrated in FIGS. 1-3 may be, for example, is a smartphone or similar device and may be configured to communicate wirelessly with other devices and networks. More specifically, the mobile device 100 may include one or more communication modules adapted to communicate over various ranges and using one or more protocols. For example, the mobile device 100 may include communication modules for communicating using one or more of Bluetooth®, Wi-Fi®, IEEE 802.11, ZigBee, and cellular communication.

The mobile device 100 may include a variety of input and output devices. For example, the mobile device 100 includes a touchscreen 104, a speaker 106, a microphone 108, an audio jack 110 (shown covered in FIGS. 1 and 2), and one or more buttons, such as a power button 112. In certain implementations, the mobile device 100 may further include one or more devices for capturing visual data such as a camera and a 2- or 3-dimensional barcode scanner. The mobile device 100 may further include a battery 114 for providing power to the mobile device 100. In certain implementations, the battery 114 may fixed to or within the mobile device 100. Alternatively, the battery 114 may be a detachable battery pack detachably coupled to the exterior of the housing 101.

The mobile device 100 may generally include a processor and one or more data storage components for storing programs executable by the processor and data collected by the mobile device 100. For example, in one implementation, one or more programs or applications may be installed on the mobile device 100 to facilitate collection of barcode data. Such programs may enable a user to collect visual data corresponding to a barcode (such as by using a camera or barcode scanner of the mobile device 100), convert the visual data to corresponding textual data, and store and/or transmit the textual data as required.

The mobile device 100 may include one or more ports, such as a micro USB port 116 (shown in FIG. 2), adapted to connect the mobile device 100 to external devices and/or power sources. The port 116 may be used to transfer data between the mobile device 100 and the external devices and/or to charge the battery 114. For example, in certain implementations, the port 116 may be adapted to receive a connector of a cable that may then be connected to the external device or a socket of a power source. In other implementations, a cradle or docking station may be used to retain the mobile device 100 when the mobile device 100 is not in use and may include one or more connectors adapted to connect to the port 116.

In implementations of the present disclosure, the mobile device 100 includes an adapter 150 that is inserted into the port 116 of the mobile device 100. As shown in FIG. 3, the adapter 150 provides an interface that extends the port 116 into a plurality of contact pads 164-170, each of which is disposed at an end of a respective one of adapter pins 156-162. The adapter 150 may further include a cover 176 defining a plurality of holes corresponding to each of the contact pads 164-170. For example, in one implementation, the port 116 of the mobile device 100 is a female micro universal serial bus (USB) port into which the adapter 150 is inserted. As discussed below in more detail, the adapter 150 includes a plurality of adapter pins that contact port pins of the port 116 and terminate in the contact pads 164-170. The contact pads 164-170 may then be used to connect the mobile device 100 to a cradle, docking station, data transfer device, or power source for transmitting data and/or recharging the mobile device 100. In certain implementations the adapter 150 is shaped or includes a sealing element such that the adapter 150 protects against ingress of dust or other particles into the port 116.

The adapter 150 enables coupling of the mobile device 100 to the data transfer device or power source based on surface contact between the contact pads 164-170 and a corresponding contact of the data transfer device or power source. Such contacts may include, without limitation, one or more of spring contacts (such as pogo pin contacts), band contacts, and corresponding contact pads. To facilitate removal of the adapter 150 from the port 116, the housing 101 may define a recess 163 adjacent the port 116, which allows a user to insert their finger or other object beneath the adapter 150.

Figure 4:
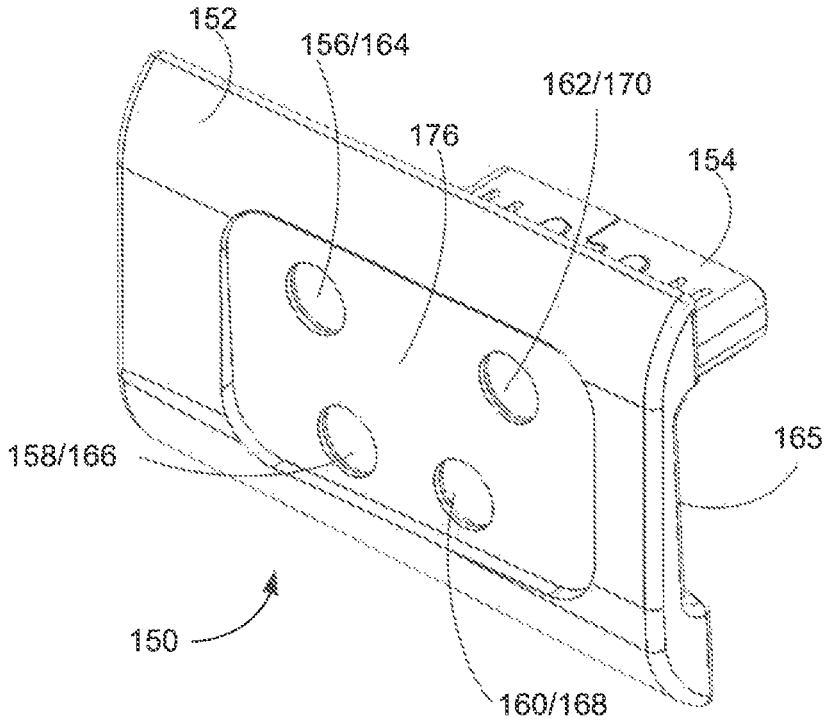
FIG. 4 is a first isometric view of the adapter of FIG. 1.
Figure 5:
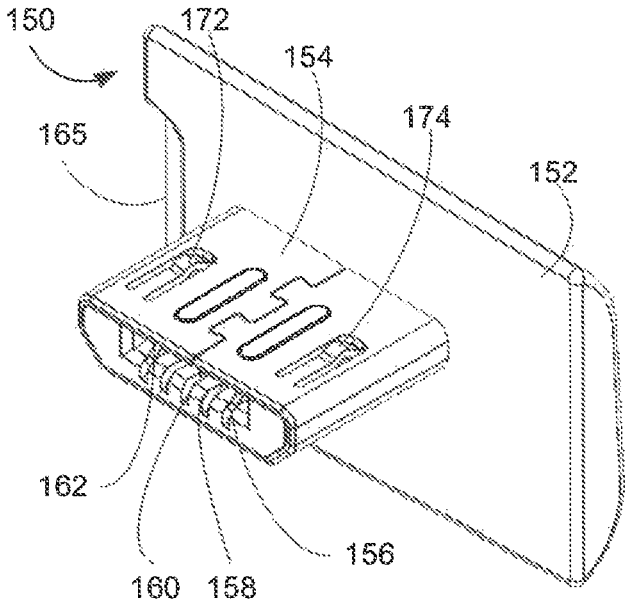
FIG. 5 is a second isometric view of the adapter of FIG. 1.

FIGS. 4 and 5 are isometric views of the adapter 150 of FIG. 1. The adapter 150 generally includes a housing 152 coupled to a connector 154. The adapter 150 includes a plurality of adapter pins 156-162 coupled to the housing 152 such that the adapter pins 156-162 extend from the connector 154 through the housing 152. The adapter pins 156-162 each terminate in a respective one of the contact pads 164-170. The connector 154 is shaped to be inserted into a corresponding port, such as the port 116 of the mobile device 100. As shown in FIG. 5, the connector 154 may include retention features, such as ribbon springs 172, 174, for positively retaining the connector 154 within the port 116. In other implementations, the retention features may be holes, grooves, or similar receptacles shaped to receive a projection or other corresponding feature of the port 116. The housing 152 may further define a recess 165 to facilitate removal of the adapter 150 from the port 116. In certain implementations, the recess 165 may align with a recess of the mobile device 100, such as the recess 163 shown in FIGS. 2 and 3, to further facilitate removal of the adapter 150 from the port 116.

Figure 6:
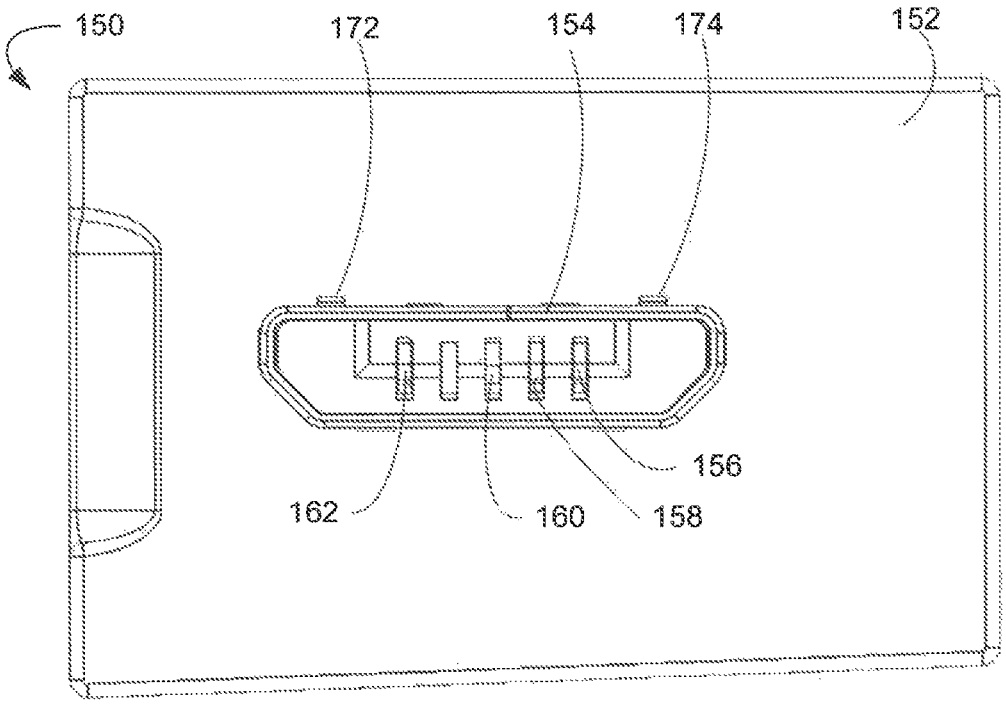
FIG. 6 is a rear view of the adapter of FIG. 1.
Figure 7:
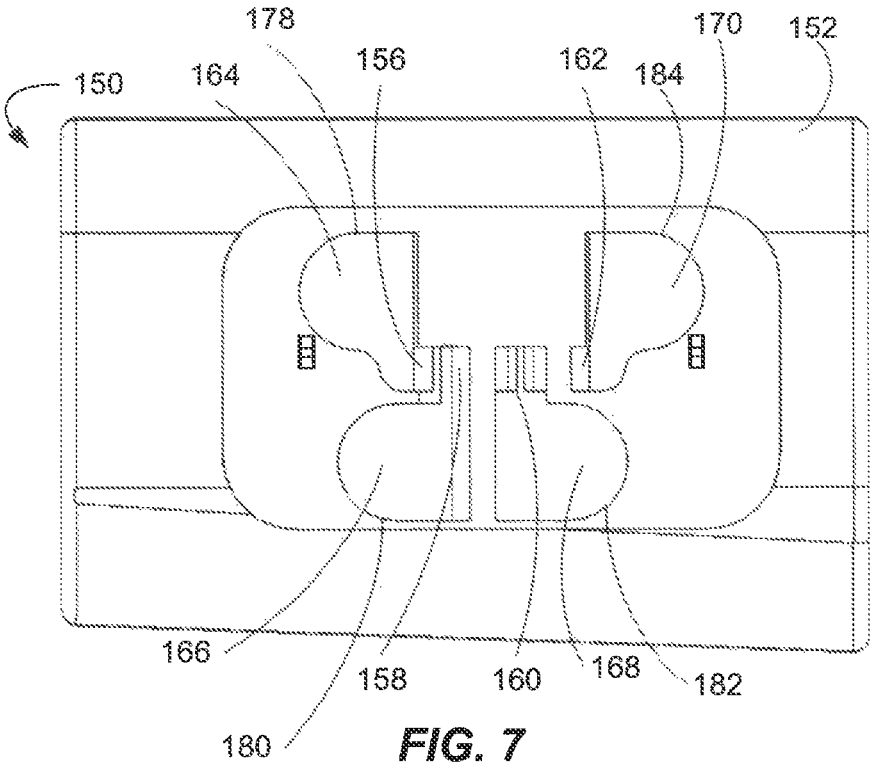
FIG. 7 is a front view of the adapter of FIG. 1 with an overlay removed.

FIG. 6 is a rear view of the adapter 150 illustrating in which the adapter pins 156-162 are visible within the connector 154. The adapter pins 156-162 are positioned to couple with corresponding port pins of the port 116 when the adapter 150 is inserted into the port 116. FIG. 7 is a front view of the adapter 150 with the cover 176 removed. As shown, each of the adapter pins 156-162 extends through the housing 152 and terminates in a respective one of the contact pads 164-170. More specifically, the housing 152 defines a plurality of recesses 178-184 into which the contact pads 164-170 are inset. In certain implementations, the recesses 178-184 are shaped such that the contact pads 164-170 are flush with the housing 152 when inserted into the recesses 178-184.

In certain implementations, the quantity of adapter pins 156-162 and respective contact pads 164-170 is fewer than the quantity of pins of the port 116. For example, in implementations in which the port 116 is a micro USB port, the port 116 includes five pins: a voltage or common collector/power supply (VCC) pin, a ground pin (GND), a low data pin (D−), a high data pin (D+) and a mode detection pin (ID). The adapter 150 then reduces the five pins of the port 116 to four contract pads 164-170 by eliminating the ID pin. In doing so, the size of the contact pads 164-170 may be increased and/or varied arrangements of the contact pads 164-170 may be implemented to facilitate a larger contact area over which the mobile device 110 can be electrically coupled to contacts of a cradle, docking station, and the like. In the example illustrated in FIG. 6, the adapter pins 156-162 correspond to the VCC pin, D− pin, D+ pin, and GND pin, respectively.

Figure 8:
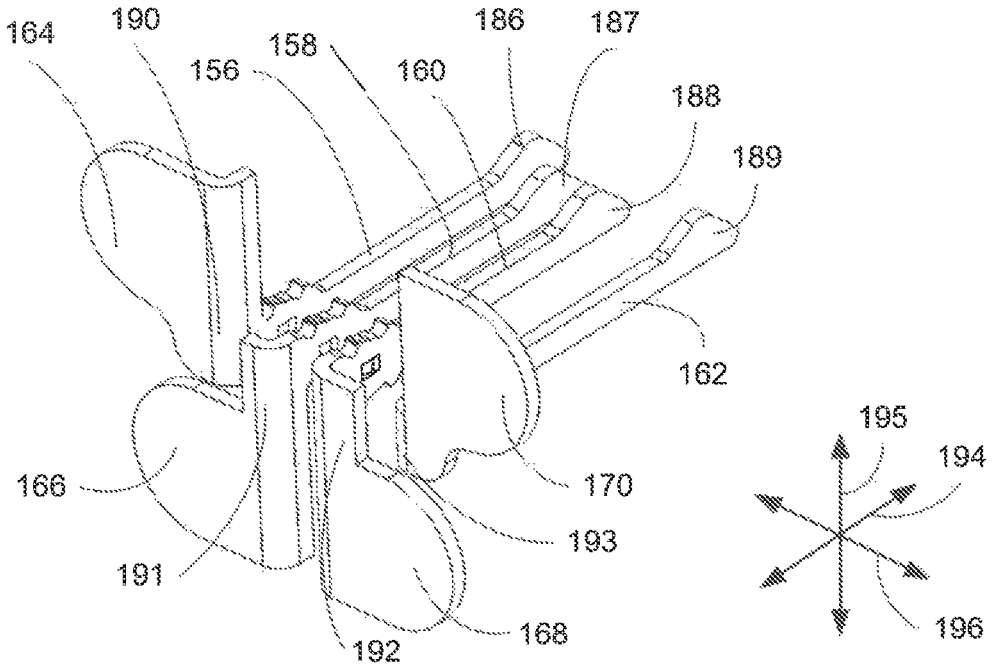
FIG. 8 is an isometric view of adapter pins of the adapter of FIG. 1.
Figure 9:
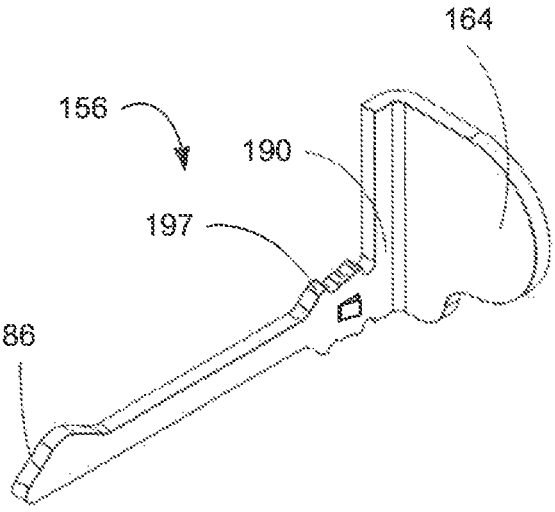
FIG. 9 is an isometric view of one of the adapter pins of FIG. 8.

FIG. 8 is an isometric view of the adapter pins 156-162 arranged as inserted into the housing 152 of the adapter 150 and FIG. 9 is an isometric view of the adapter pin 156. Referring first to FIG. 8, each of the adapter pins 156-162 includes a first portion including a respective pin end 186-189 and a second portion including a respective one of the contact pads 164-170. The adapter pins 156-162 may further include intermediate portions 190-193 coupling the first portions including the end pins 186-189 to the second portions including the contact pads 164-170.

Although various arrangements of the adapter pins 164-170 are possible, the pin ends 186-189, intermediate portions 190-193, and contact pads 164-170 may be arranged to increase the surface area of each contact pad 164-170 and the displacement between the contact pads 164-170. For example, in certain implementations, the pin ends 186-189 may extend parallel to each other in a direction along a first axis 194. The intermediate portions 190-193 may then extend perpendicular to the first direction along a second axis 195. As shown in FIG. 8, subsets of the intermediate portions 190-193 may extend in opposite directions. For example, intermediate sections 190 and 193 are shown in FIG. 8 as extending in a first direction and intermediate sections 191 and 192 are shown extending in a second direction opposite the first direction. The contact pads 164-170 may then extend perpendicular to each of the pin ends 186-189 and the intermediate portions 190-193, i.e., along a third axis 196. Similar to the intermediate portions 190-193, the contact pads 164-170 may extend in different directions along the third axis 196. For example, contact pads 164 and 166 are shown in FIG. 8 extending in a first direction along the third axis 196 while contact pads 168 and 170 are shown as extending opposite the first direction.

FIG. 9 is an isometric view of the adapter pin 156 and is described with the understanding that the general features of the adapter pin 156 may apply to any of the remaining adapter pins 158-162. As illustrated in FIG. 9, the adapter pin 156 may be a unitary structure formed from a conductive material such as, without limitation, one or more of gold, platinum, silver, copper, and alloys thereof. During manufacturing, the adapter pin 156 may be stamped in a substantially flat shape and then bent such that the contact pad 164 of the adapter pin 156 extends perpendicular to the pin end 186 of the adapter pin 156. As illustrated in FIG. 9, the adapter pin 156 may further include a barbed section 197 adapted to engage the housing 152 (shown, for example, in FIGS. 4-7).

Figure 10:
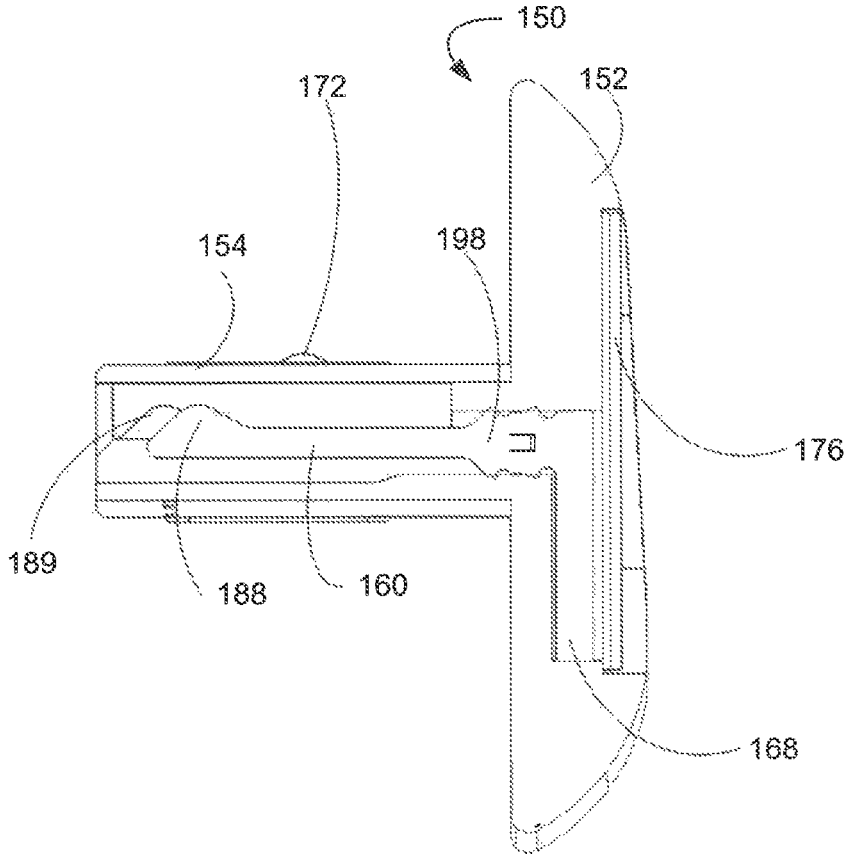
FIG. 10 is a cross-sectional side view of the adapter of FIG. 1.

FIG. 10 is a cross-sectional view of the adapter 150. As shown in FIG. 10, the adapter pin 160 extends through the housing 152. More specifically, the contact pad 168 of the adapter pin 160 is disposed within a recess 182 on a first side of the housing 152 and extends through the housing 152 into a connector 154 coupled to a second side of the housing 152 opposite the first side. The adapter pin 160 extends into the connector 154 and terminates in a pin end 188 positioned to contact a corresponding pin of a port into which the connector 154 is inserted. The adapter pin 160 further includes barbs 198 adapted to grip the housing 152 when the adapter pin 160 is inserted into the housing 152.

As shown in FIG. 10, the adapter pin 160 is a unitary component that extends from the front face of the housing 152 through the connector 154. As a result, a printed circuit board (PCB) or similar circuitry for coupling the contact pad 168 to the pin end 188 is not required. By eliminating the need for such intermediate circuitry and associated support structures, the overall length and profile of the adapter 150 may be reduced, further enabling flush mounting of the adapter 150 when inserted into a mobile device (such as shown in FIG. 1).

Figure 11:
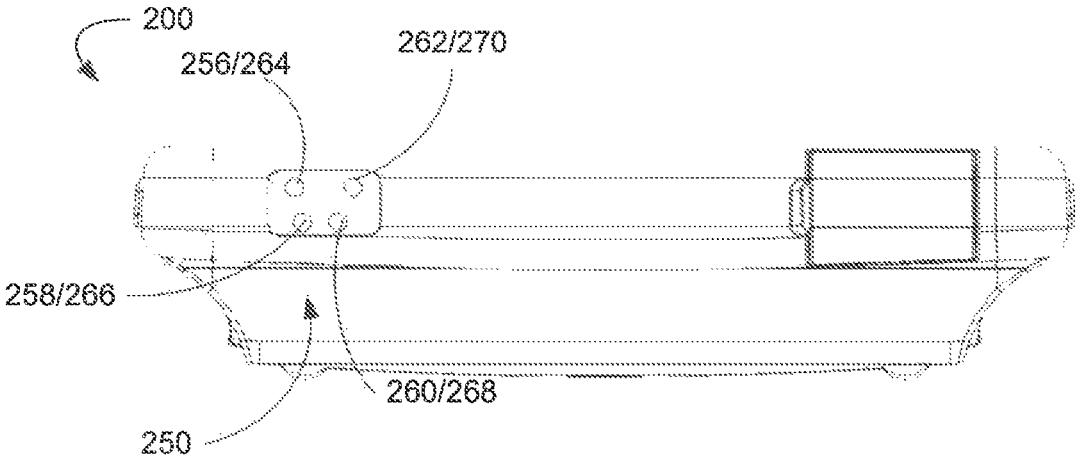
FIG. 11 is a bottom view of a second mobile device including a second adapter in accordance with this disclosure that is integrated into the mobile device.
Figure 12:
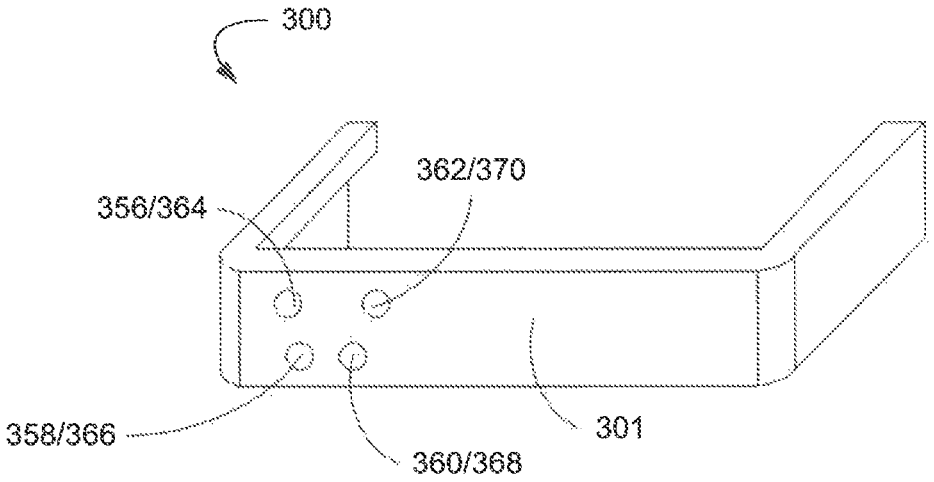
FIG. 12 is an isometric view of a mobile device case including a third adapter in accordance with this disclosure and that is integrated into the mobile device case.

FIGS. 11 and 12 are isometric views of alternative implementations of the present disclosure. In contrast to the adapter 150 illustrated in FIGS. 1-8 and 10, FIG. 11 depicts a mobile device 200 in which an adapter 250 is integrally formed with a housing 201. The adapter 250 includes a plurality of adapter pins 256-262, each of which terminates in a respective contact pad 264-270. In certain implementations in which an adapter is integral with the mobile device, a port, similar to port 116 of the mobile device 100 illustrated in FIG. 2, may be disposed within the housing 201 and the adapter pins 256-262 may substantially conform to the general shape and layout as the adapter pins 156-162 of the mobile device 100.

FIG. 12 illustrates an implementation in which an adapter 350 in accordance with this disclosure is integrated into a case 300 for a mobile device. The case 300 includes a case body 301 into which the adapter 350 may be integrated. The adapter 350 may include a plurality of adapter pins 356-362 that terminate in respective contact pads 364-370. The adapter 350 may include a connector similar to the connector 154 of the adapter 150 illustrated in FIGS. 1-7 and 10 and that extends inward from the case 300. A mobile device may be inserted into the case 300 such that the connector is inserted into a corresponding port of the mobile device. In certain implementations the case 300 may be formed of one or more of plastic, rubber, or other material selected to provide shock absorption and general protection of the mobile device. Moreover, although the case 300 is illustrated as being a partial case that receives only a portion of a mobile device, in other implementations, a case including an adapter as disclosed herein may extend substantially around the exterior of a corresponding mobile device.

It is believed that the present disclosure and many of its attendant advantages should be understood by the foregoing description, and it should be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it should be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

The invention claimed is:

1. An adapter for use with a mobile device including a port having a plurality of port pins, the adapter comprising:

a housing;

a connector adapted to be inserted into the port and coupled to a first side of the housing; and a plurality of adapter pins coupled to and extending through the housing, each adapter pin comprising:

a first portion comprising a pin end extending into the connector in a first direction such that the pin end contacts a respective port pin of the plurality of port pins when the connector is inserted into the port, and a second portion comprising a contact pad exposed on a second side of the housing opposite the first side, the contact pad transversely extending relative to the first direction and laterally offset from the pin end, wherein the adapter includes fewer adapter pins than port pins.

2. The adapter of claim 1, wherein the second portion of each adapter pin extends perpendicular to the first direction.

3. The adapter of claim 2, wherein the second portions of a first set of the adapter pins extend in a second direction and the second portions of a second set of the adapter pins extend in a third direction opposite the second direction.

4. The adapter of claim 2, wherein at least one adapter pin of the plurality of adapter pins further comprises an intermediate portion disposed between the first portion and the second portion, the intermediate portion extending perpendicular to each of the first direction and the second portion.

5. The adapter of claim 2, wherein a plurality of the adapter pins comprise an intermediate portion disposed between the first portion and the second portion, the intermediate portion extending perpendicular to each of the first direction and the second portion, the intermediate portions of a first set of the adapter pins extending in a second direction and the intermediate portions of a second set of the adapter pins extending in a third direction opposite the second direction.

6. The adapter of claim 1, wherein each adapter pin of the plurality of adapter pin includes at least one barb adapted to couple the adapter pin to the housing.

7. The adapter of claim 1, wherein the housing defines a plurality of recesses, each recess adapted to receive a respective contact pad such that the contact pad is flush with the housing.

8. The adapter of claim 7 further comprising an overlay disposed over the second side of the housing and defining a plurality of holes, each hole of the plurality of holes aligned with a respective contact pad.

9. The adapter of claim 1, wherein a first set of the adapter pins are adapted to transmit data and a second set of the adapter pins are adapted to transmit power.

10. The adapter of claim 1, wherein each of the contact pads are adapted to contact a tip of a spring-loaded connector.

11. The adapter of claim 1, wherein the connector is a micro universal serial bus (USB) connector.

12. The adapter of claim 1, wherein the adapter is integrated into a case adapted to receive at least a portion of the mobile device.

13. A mobile device comprising:

a mobile device body comprising a plurality of port pins; and an adapter comprising a plurality of adapter pins, each adapter pin of the plurality of adapter pins comprising a pin end extending in a pin end direction and a contact pad opposite the pin end, the contact pad transversely extending relative to the pin end direction and laterally offset from the pin end, wherein each of the plurality of adapter pins is electrically coupled with a respective port pin of a subset of the plurality of port pins such that the quantity of adapter pins is less than the quantity of port pins.

14. The mobile device of claim 13, wherein the adapter is integral with the mobile device body.

15. The mobile device of claim 13, wherein the adapter is detachable from the mobile device.

16. The mobile device of claim 15, wherein the mobile device comprises a mobile device housing and the adapter is integrated into a case coupled to at least a portion of the mobile device housing.

17. The mobile device of claim 13, wherein the port pins are micro universal serial bus (USB) port pins.

18. An adapter for use with a mobile device including a micro universal serial bus (USB) port having each of a power supply port pin, a ground port pin, a high data port pin, a low data port pin, and a mode pin, the adapter comprising:

a housing;

a connector coupled to a first side of the housing and adapted to be inserted into the micro USB port; and a plurality of adapter pins extending through the housing, the plurality of adapter pins consisting of a power supply adapter pin, a ground adapter pin, a high data adapter pin, and a low data adapter pin, each of the plurality of adapter pins comprising a first portion extending into the connector and a second portion extending perpendicular to the first portion and comprising respective contact pads exposed on a second side of the adapter opposite the first side, wherein the power supply adapter pin, the ground adapter pin, the high data adapter pin, and the low data adapter pin are adapted to contact the power supply port pin, the ground port pin, the high data port pin, and the low data port pin, respectively, when the connector is inserted into the port.

19. The adapter of claim 18, wherein the first portions of each of the adapter pins extends in a first direction, the second portion of the power supply adapter pin and the low data adapter pin extend in a second direction perpendicular to the first direction, and the high data pin and the ground pin extend in a third direction opposite the second direction.

20. The adapter of claim 19, wherein each of the adapter pins further comprises an intermediate portion disposed between the respective first and second portions, wherein the intermediate portions of the power supply adapter pin and the ground adapter pin extend in a fourth direction perpendicular to each of the first, second, and third directions and the intermediate portions of the low data adapter pin and the high data adapter pin extend in a fifth direction opposite the fourth direction.

* * * * *